US006732484B1

(12) United States Patent
Sotelo et al.

(10) Patent No.: US 6,732,484 B1
(45) Date of Patent: May 11, 2004

(54) CHAIR SUPPORT FOR METAL REINFORCEMENTS

(75) Inventors: Oscar Sotelo, McAllen, TX (US); Ruben DeLeon, McAllen, TX (US)

(73) Assignee: Bar-Lift, Inc., McAllen, TX (US)

( * ) Notice: Subject to any disclaimer, the term of this patent is extended or adjusted under 35 U.S.C. 154(b) by 0 days.

(21) Appl. No.: 10/310,944

(22) Filed: Dec. 5, 2002

(51) Int. Cl.[7] ..... E04C 5/16

(52) U.S. Cl. ..... 52/687; 52/677; 52/686; 52/682; 52/684

(58) Field of Search ..... 52/677, 686, 687, 52/682, 684, 685; 404/135, 136

(56) References Cited

U.S. PATENT DOCUMENTS

| | | | | |
|---|---|---|---|---|
| 3,255,565 A | * | 6/1966 | Menzel | 52/678 |
| 3,292,335 A | | 12/1966 | Stober | |
| 3,449,882 A | | 6/1969 | Ott | |
| 3,694,988 A | | 10/1972 | Skold | |
| 4,063,397 A | | 12/1977 | Follows | |
| 4,831,803 A | * | 5/1989 | Leonardis | 52/323 |
| 5,107,654 A | | 4/1992 | Leonardis | |
| 6,089,522 A | * | 7/2000 | Haslem et al. | 248/440 |
| 6,345,474 B1 | * | 2/2002 | Triplett | 52/169.9 |
| 6,663,316 B1 | * | 12/2003 | Harris | 404/136 |

FOREIGN PATENT DOCUMENTS

| | | | | |
|---|---|---|---|---|
| GB | 2006314 A | * | 5/1979 | 52/684 |

* cited by examiner

*Primary Examiner*—Ramon O. Ramirez
(74) *Attorney, Agent, or Firm*—G. Turner Moller

(57) ABSTRACT

A chair supports rebar or wire mesh during a concrete pour. The chair is box shaped having grooves in the side walls of different width for supporting rebar of different diameter. Notches in the edge of the grooves on opposite sides of the chair support wire mesh of different diameter. The notches are shaped so the wire mesh is snapped into the notch. Wall like braces extend across the inside of the chair and support the grooves from the opposite wall. The larger grooves are on the short sides of the chair to raise the rebar a longer distance off the underlying surface. In a preferred embodiment, the chair provides two elevations for placement of rebar, namely 2" and 3" above an underlying surface. Parts of the box are cut away to promote concrete movement through the chair. Slots are provided to allow air trapped in the concrete to escape from the chair.

18 Claims, 2 Drawing Sheets

FIG. 7
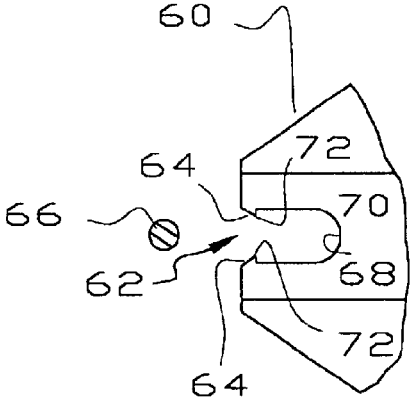
FIG. 5
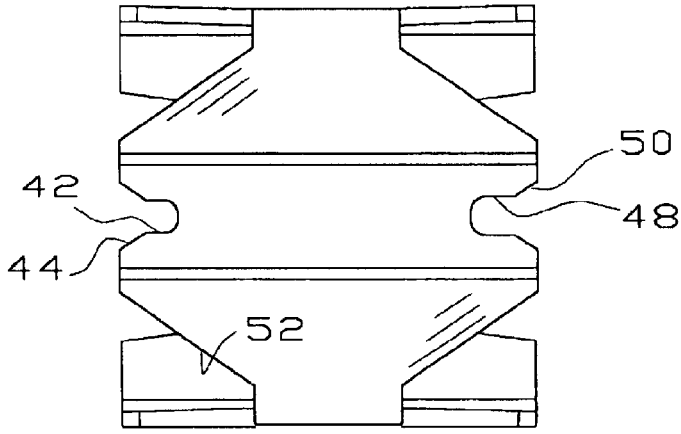
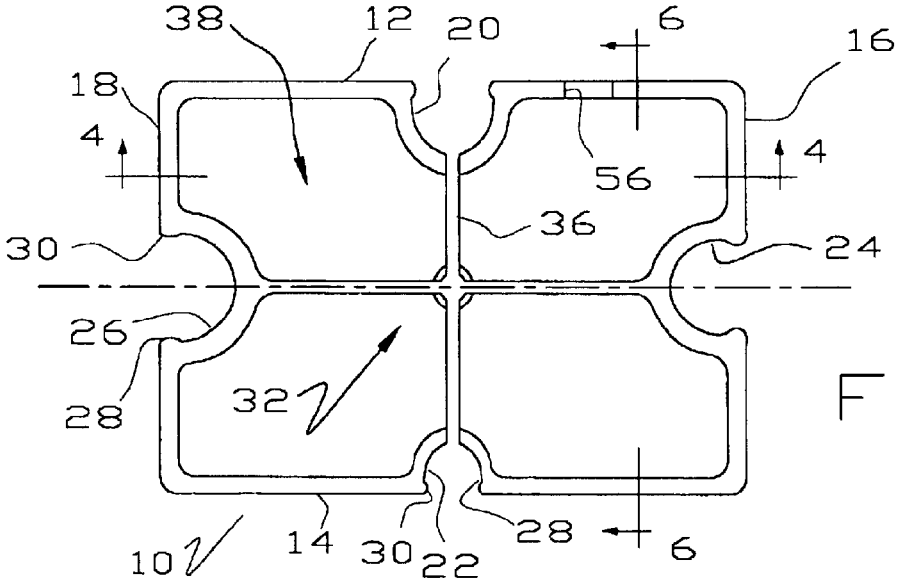
FIG. 3
FIG. 6
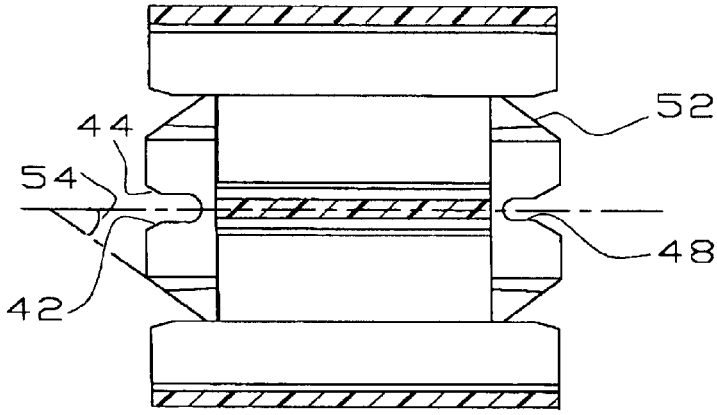

CHAIR SUPPORT FOR METAL REINFORCEMENTS

This invention relates to a chair that is used to support rebar and wire mesh during a concrete pour, and more particularly to a chair that is capable of supporting rebar and wire mesh in a wide range of sizes and at two different elevations.

BACKGROUND OF THE INVENTION

In the pouring of concrete, metal reinforcements such as rebar or wire mesh are used to increase the strength of concrete. By itself, concrete is very strong in compression but surprisingly weak in tension. The inclusion of metal reinforcements in concrete increases the tensile strength substantially, allowing concrete to be used in many applications.

To increase strength, the metal reinforcements should be in the middle of the concrete, rather than toward one side. In a normal situation where a horizontal slab is being poured, this means the metal reinforcements should be above ground level and at about the center of the finished slab. It is accordingly necessary to provide a support, known as a chair, for the metal reinforcement to keep it off the underlying surface. Early on, the support was a rock or piece of brick. Chairs have evolved over time and become much more sophisticated.

There are a variety of chairs which have the capability of supporting different sized rebar. It is this type chair that this invention most nearly relates. Disclosures of interest relative to this invention are found in U.S. Pat. Nos. 3,292,335; 3,449,882; 3,694,988; 4,063,397 and 5,107,654.

SUMMARY OF THE INVENTION

The chair of this invention is a generally rectangular or box shaped structure having two walls that are generally parallel and two intersecting walls that are generally parallel. A groove is provided in at least most of the walls and preferably in all of the walls. The grooves are of different width to receive and support rebar of different diameter. The grooves are preferably in the center of each wall so the load on the chair is evenly distributed to the opposite wall. A pair of intersecting wall-like braces extend across the walls of the chair on the inside of the perimeter to reinforce the grooves and thereby strengthen the chair. The grooves run in the short direction of the chair so the braces do not block movement of concrete through the interior of the chair.

The corners of the chair are preferably angled to allow concrete to move readily into and out of the inside of the chair to promote even distribution of concrete and minimize the creation or retention of air pockets. A series of slots are provided in the walls to allow trapped air to more readily migrate upwardly out of the concrete.

It is an object of this invention to provide an improved chair to support metal reinforcements during a concrete pour.

Another object of this invention is to provide a chair having the capability of supporting a wide range of rebar and/or wire mesh during a concrete pour.

Another object of this invention is to provide a chair having the capability of supporting metal reinforcements at different elevations above an underlying surface.

A further object of this invention is to provide a chair that is sturdy and provides a wide base of support for metal reinforcements used in a concrete pour.

These and other objects of this invention will become more fully apparent as this description proceeds, reference being made to the accompanying drawings and appended claims.

BRIEF DESCRIPTION OF THE DRAWINGS

FIG. 3 is a top view of the chair of FIG. 1;

FIG. 5 is an end view of the chair of FIG. 1;

FIG. 6 is a cross-sectional view of the chair of FIG. 3, taken along line 6—6 thereof as viewed in the direction indicated by the arrows; and FIG. 7 is an enlarged partial view of an improved embodiment incorporating an improved wire receiving notch.

DETAILED DESCRIPTION

Figure 2:
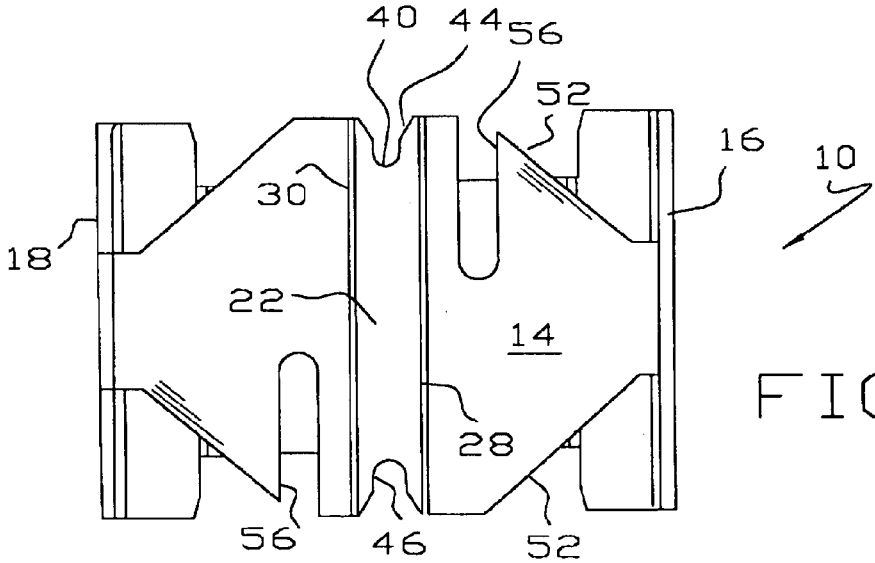
FIG. 2 is a side elevational view of the chair of FIG. 1.
Figure 4:
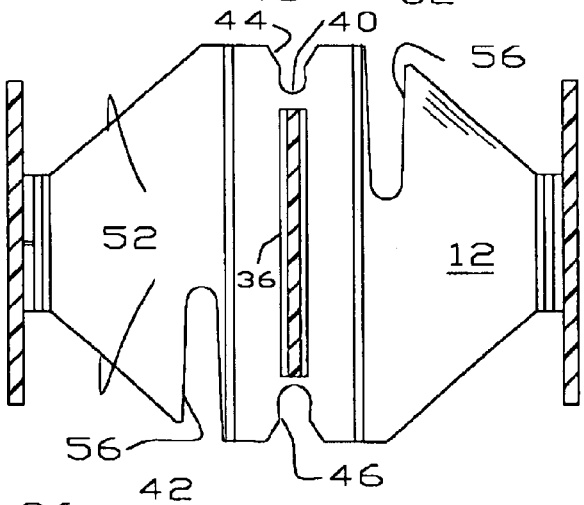
FIG. 4 is a cross-sectional view of the chair of FIG. 3, taken substantially along line 4—4 thereof as viewed in the direction indicated by the arrows.
Figure 1:
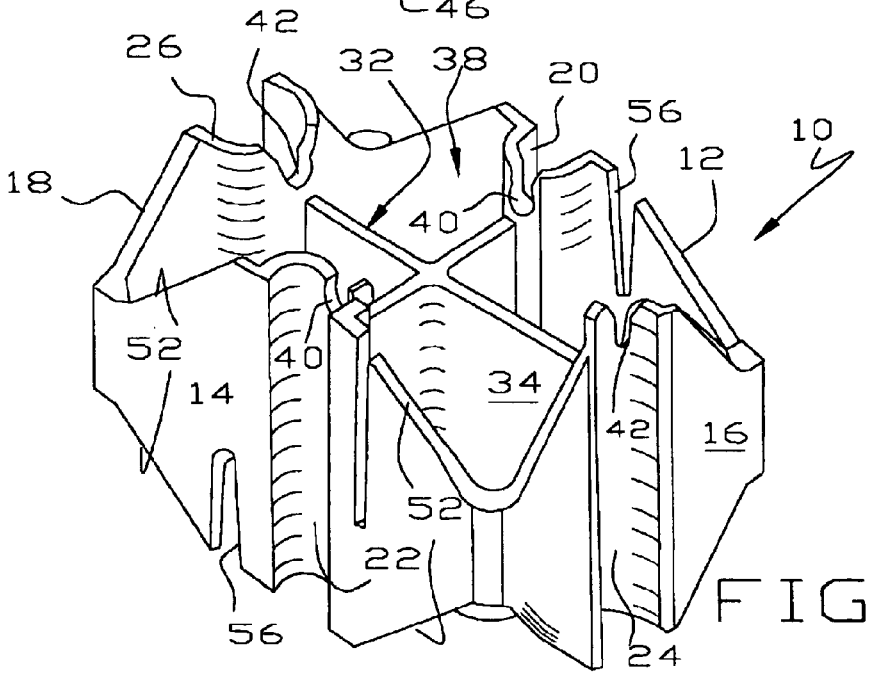
FIG. 1 is an isometric view of a chair of this invention.

Referring to FIGS. 1–6, a chair 10 of this invention is designed to support and retain metal reinforcements during a concrete pour. The chair 10 is a box shaped structure and is preferably longer on one side than on the other to position the metal reinforcements at different heights above an underlying surface depending on the orientation of the chair 10. The chair 10 includes a series of grooves to support rebar, the grooves being of different width to accommodate rebar of different diameter. The short sides of the rectangular chair 10 provide the wider grooves so, when larger rebar is being used, it is supported a greater distance off an underlying surface. The chair 10 is conveniently made of injection molded plastic and includes a series of internal braces to strengthen the box shaped structure.

To these ends, the chair 10 includes a pair of long parallel side walls 12, 14 and a pair of short parallel end walls 16, 18 perpendicular to the side walls 12, 14. The long walls 12, 14 are preferably perpendicular to the short walls 16, 18 so the chair 10 sits symmetrically when placed on either a short wall or a long wall, i.e. the chair 10 does not tilt when placed in an operative position.

Each of the walls 12, 14, 16, 18 provides a groove 20, 22, 24, 26. As shown best in FIG. 3, the grooves 20, 22 are of different size and the grooves 24, 26 are of different size. The two smaller grooves 20, 22 are on the long sides 12, 14 and the two larger grooves 24, 26 on the short sides 16, 18. Although the grooves 20, 22, 24, 26 may be of any desired size, they are preferably of a size to receive and retain current conventional rebar. It will be seen that each of the grooves is bounded by a pair of parallel ribs 28, 30 providing a restricted entry into the grooves of a slightly smaller dimension than the diameter of the rebar. Accordingly, rebar of a diameter that fits within the grooves is forced past, or snapped through, the ribs 28, 30 so the rebar is retained within the grooves. This is advantageous because raising a rebar rod does not allow the rod to move out of the groove. The grooves 20, 22, 24, 26 are preferably in the center of its respective wall 12, 14, 16, 18 so the load of the rebar is evenly distributed.

In the preferred embodiment, the grooves 22, 24 are of the same size to receive the same size rebar. This is desirable because the rebar of one size is often used on concrete slabs of considerably different thickness. By placing the same size groove 22, 24 on adjacent faces 14, 16, the chair 10 can be used to position the rebar in the middle of concrete slabs of substantially different thickness.

As illustrated, the chair 10 is capable of accommodating three different sizes of rebar. Although the exact sizes are subject to selection by the designer, it is preferred that the grooves 20, 22–24, 26 accommodate rebar of ⅜", ½" and ⅝" diameter. It will be apparent, however, that the grooves 20, 22, 24, 26 may all be of different size to accommodate four sizes of rebar. The chair 10 is conveniently about 2½" wide and 3⅝" long which positions the rebar either 2" or 3" above an underlying surface and thereby provides appropriate spacing for rebar of ⅜"–⅝" diameter. It will be apparent that the overall size of the chair 10 is subject to wide variation and larger versions are appropriate for larger sized rebar to position larger rebar further from an underlying surface.

An important feature of the chair 10 is a bracing system 32 comprising a pair of intersecting wall-like braces 34, 36 inside the cavity 38 provided by the walls 12, 14, 16, 18. Each of the braces 34, 36 terminates in the middle of one of the grooves 20, 22, 24, 26 and provides a support for the wall forming the groove. The braces 34, 36 form an X or + shaped structure perpendicular to the walls 12, 14, 16, 18 so that, when loaded, each of the walls and grooves is supported from the underlying surface abutting the opposite side of the chair 10. As will be more fully apparent hereinafter, the chair 10 lies on one of the walls 12, 14, 16, 18 when supporting rebar in a concrete pour so the braces 32, 34 are vertical when loaded.

An important feature of the chair 10 is the ability to accommodate metal reinforcements in the form of wire mesh. To this end, a pair of aligned notches 40 are provided in the grooves 20, 22 and a pair of aligned notches 42 of the same size are provided in the grooves 24, 26 on one side of the chair 10. The bottoms of the notches 40, 42 are spaced from the opposite edge of the chair 10 the same distance so wire mesh can be supported at an intersection. The notches 40, 42 are slightly larger than one conventional diameter wire mesh. Although the notches 40, 42 may be of any desired width, they are conveniently about 0.160 inches wide to accommodate a wire mesh of ⅛" diameter. When the chair 10 is being used to support wire mesh, it will be positioned with an edge on the underlying surface. This is substantially weaker than when the chair 10 is lying on one of the walls 12, 14, 16, 18 but the loads imparted by wire mesh to the chair 10 are much lower. The entrance into the bottom of the notches 40, 42 is provided by edges 44 converging toward the notches 40, 42 thereby assisting in the placement of the wire mesh in the notches 40, 42.

To accommodate wire mesh of different size, a second set of notches 46, 48 is provided on the opposite side of the chair 10. The notches 46, 48 open through the grooves and are larger than the notches 40, 42. Although the notches 46, 48 may be of any suitable size, they are conveniently 0.207" wide to accommodate a wire of 3⁄16" diameter. The entrance to the bottom of the notches 46, 48 is provided by converging edges 50 thereby assisting in the placement of wire mesh in the notches 46, 48.

An important feature of the chair 10 lies in minimizing resistance to concrete flow and thereby aiding in minimizing the development of air pockets in the concrete slab. To this end, the corners of the chair 10 are beveled, i.e. the edges 52 of the walls 12, 14, 16, 18 converge toward the center of the walls 12, 14, 16, 18 at the corners. Although the edges 52 may be at any suitable angle, an angle of 35° relative to the centerline as shown by the angle 54 in FIG. 6 is appropriate. This allows relative free concrete flow into and through the cavity 36 than a situation where the corners of the chair 10 were of the same height as the center. Reducing the height of the walls 12, 14, 16, 18 on the corners also reduces the weight of the chair 10 which is an important contribution to its low cost.

An important feature of the chair 10 lies in allowing air trapped in the cavity 36 to escape. When using the chair 10 to support rebar, one of the walls 12, 14, 16, 18 lies on the underlying surface so its opposite wall is typically horizontal., There is a tendency for air to become trapped under the horizontal wall spaced from the underlying surface. This tendency is most pronounced when one of the long walls 12, 14 is on the underlying surface because it is obviously larger than the short walls 16, 18 and thus more likely to trap air. This tendency is ameliorated by the provision of slots 56 in the long walls 12, 14 which allow any air under the elevated long wall to escape.

Use of the chair 10 should now be apparent. If rebar is to be used to reinforce concrete in a pour, the rebar is laid on the underlying surface and tied in a conventional manner. One of the rebar rods will be on top and one on bottom at their intersections. The lower rebar rod is raised from the underlying surface and one of chairs 10 placed beneath it with the groove 20, 22, 24, 26 corresponding to the size of the rebar facing up. If the rebar is of a size to fit in the groove 22, 24, the user selects whether the long walls 12 or the short wall 18 is to be on the underlying surface to space the rebar near the center of the concrete slab. The rebar is pushed past the ribs 28, 30, or snapped, into the appropriate groove and the chair 10 lowered to rest on the underlying surface. The brace intersecting the groove in which the rebar is placed acts to transfer a major part of the load of the rebar to the underlying surface. Concrete is poured into the prepared area and finished in a conventional manner.

If wire mesh is to be used to reinforce concrete in a pour, the wire mesh is laid on the underlying surface and then raised and one of chairs 10 placed beneath it, preferably at an intersection, with the notch 40, 42 or 46, 48 corresponding to the size of the wire mesh facing up. The wire is pushed or dropped into the appropriate groove and the chair 10 lowered to rest on the underlying surface. Because the chair 10 is on edge, the load of the wire mesh is transferred to the underlying surface by the vertical walls 12, 14, 16, 18. Concrete is poured into the prepared area and finished in a conventional manner.

Referring to FIG. 7, there is illustrated a chair 60 having an improved notch 62 for receiving wire mesh. In particular, the notch 62 is sized and shaped so wire being supported in the notch is snapped into the notch 62 past a restriction which is slightly smaller than the wire. In this manner, the wire is captivated to the chair 60 and the chair 60 is not easily dislodged from the wire. To this end, the notch 62 comprises a pair of diverging edges 64 which act to direct a wire 66 toward a slot 68 in the wall 70 of the chair 60. At the junction of the edges 64 and the slot 68 are a pair of shoulders or bumps 72 which are spaced apart smaller than the diameter of the wire 66. Thus, if the notch 62 is designed to receive ⅛" diameter wire, the bumps 72 are spaced apart on the order of 0.100 inches and the slot 68 is on the order of 0.160 wide. There is sufficient flexibility in the wall 70 to allow the wire 66 to pass between the shoulders 72. The depth of the slot 66 is subject to wide variation and typically is greater than ⅜". All of the notches 62 on one side of the chair 60 are of the same size so wire mesh can be supported at the intersection and all of the notches 62 on the other side of the chair 60 are of a different size.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

We claim:

1. A chair for supporting metal reinforcements used in a concrete pour, comprising a first set of generally parallel walls and a second set of generally parallel walls intersecting the first set of walls and providing a cavity therebetween;

a plurality of the walls providing a groove opening through an exterior of the walls, at least some of the grooves being of different width to receive and support rebar of different thickness; and a brace extending from each groove to an opposite wall.

2. The chair of claim 1 wherein the first walls are longer than the second walls.

3. The chair of claim 2 wherein at least some of the grooves in the first wall are of smaller width than at least some of the grooves in the second wall thereby positioning reinforcements in the grooves of the first wall closer to an underlying surface than reinforcements in the grooves of the second wall.

4. The chair of claim 3 wherein one of the grooves in the first wall is of the same width as one of the grooves in the second wall.

5. The chair of claim 2 wherein at least one of the first walls provides an elongate slot opening from the cavity through the first wall.

6. The chair of claim 5 wherein the slot opens through an edge of the first wall.

7. The chair of claim 2 wherein the chair is a generally rectangular box.

8. The chair of claim 2 wherein a first wall groove is located along a centerline of each of the first walls and the brace extending between the first walls extends between the first wall grooves.

9. The chair of claim 8 wherein a second wall groove is located along a centerline of each the second walls and the brace extending between the second walls extends between the second wall grooves.

10. The chair of claim 1 wherein the walls intersect perpendicularly.

11. The chair of claim 10 wherein edges of the first and second walls incline to the intersections.

12. The chair of claim 1 wherein the walls provide first and second peripheral edges on opposite sides of the chair and further comprising a first pair of aligned notches in an edge of the first periphery having a first width for receiving and supporting a wire of a first thickness; and a second pair of aligned notches in an edge of the second periphery having a second width greater than the first width for receiving and supporting a wire of a second thickness different than the first thickness.

13. The chair of claim 12 wherein the first pair of notches are in an edge of grooves in the first wall.

14. The chair of claim 13 wherein the second pair of notches are in an edge of grooves in the first wall.

15. The chair of claim 1 wherein the walls provide first and second peripheral edges on opposite sides of the chair and further comprising a first pair of aligned notches in an edge of the first periphery having a width for receiving and supporting a wire of a predetermined thickness; and a second pair of aligned notches in an edge of the first periphery having a width for receiving and supporting a wire of a same predetermined thickness, the first and second pair of aligned notches defining perpendicular axes for receiving perpendicular wires therebetween.

16. A chair for supporting metal reinforcements used in a concrete pour, comprising a first set of generally parallel walls and a second set of generally parallel walls intersecting the first set of walls and providing a cavity therebetween;

a plurality of the walls providing a groove opening through an exterior of the walls, the grooves being of different width to receive and support rebar of different thickness;

a first pair of aligned notches in an edge of the first wall for receiving and supporting a mesh of wire of a first thickness; and a second pair of aligned notches in an edge of the second wall for receiving and supporting a mesh of wire of a second thickness different than the first thickness.

17. A chair for supporting metal reinforcements used in a concrete pour, comprising a polygonal shell forming a cavity and including a set of generally parallel first walls and a set of second walls intersecting the first set of walls; and a plurality of the walls providing a groove opening through an exterior of the walls, the grooves in the first walls being of different width to receive and support rebar of different thickness;

the polygonal shell being supportable on an underlying surface by a first of the first walls and the groove in a second of the first walls being spaced a first predetermined distance from an underlying surface, the polygonal shell being supportable on an underlying surface by one of the second walls and the groove in an opposite wall being spaced a second predetermined distance, different from the first predetermined distance, from the underlying surface.

18. The chair of claim 17 wherein the polygonal shell is rectangular, the first walls being longer than the second walls, the first walls having at least some grooves smaller than the grooves of the second walls.

* * * * *